United States Patent [19]

Ottenstein

[11] Patent Number: 4,777,410

[45] Date of Patent: Oct. 11, 1988

[54] BALLAST STRIKER CIRCUIT

[75] Inventor: Sidney A. Ottenstein, Spring, Tex.

[73] Assignee: Innovative Controls, Inc., Houston, Tex.

[21] Appl. No.: 65,274

[22] Filed: Jun. 22, 1987

[51] Int. Cl.[4] ..... H05B 37/00

[52] U.S. Cl. ..... 315/227 R; 315/238; 315/207

[58] Field of Search ..... 315/227, 240, 207, 205

[56] References Cited

U.S. PATENT DOCUMENTS

| | | | |
|---|---|---|---|
| 3,222,572 | 12/1965 | Powell, Jr. | 315/151 |
| 3,247,422 | 4/1966 | Schultz | 315/206 |
| 3,259,797 | 7/1966 | Heine et al. | 315/174 |
| 3,265,930 | 8/1966 | Powell, Jr. | 315/209 |
| 3,309,567 | 3/1967 | Flieder et al. | 315/176 |
| 3,479,560 | 11/1969 | Paget et al. | 315/105 |
| 3,482,142 | 12/1969 | Cluett et al. | 315/105 |
| 3,500,128 | 3/1970 | Liepins | 315/278 |
| 3,505,562 | 4/1970 | Engel | 315/206 |
| 3,544,839 | 12/1970 | Fahnrich | 315/200 |
| 3,569,776 | 3/1971 | Moerkens | 315/102 |
| 3,626,243 | 12/1971 | Koyama et al. | 315/100 |
| 3,644,780 | 2/1972 | Koyama et al. | 315/100 |
| 3,649,869 | 3/1972 | Nomura et al. | 315/205 |
| 3,659,146 | 4/1972 | Munson | 315/92 |
| 3,659,150 | 4/1972 | Laupman | 315/106 |
| 3,705,329 | 12/1972 | Vogeli | 315/103 |
| 3,771,068 | 11/1973 | Paget et al. | 315/20 |
| 3,774,073 | 11/1973 | Switsen | 315/227 |
| 3,836,817 | 9/1974 | Tchang et al. | 315/100 |
| 3,857,060 | 12/1974 | Chermin | 315/99 |
| 3,875,459 | 4/1975 | Remery et al. | 315/205 |
| 3,882,354 | 5/1975 | May | 315/101 |
| 3,894,165 | 7/1975 | Holmes et al. | 315/194 |
| 3,904,921 | 9/1975 | Imaizumi et al. | 315/101 |
| 3,924,155 | 12/1975 | Vogeli | 315/97 |
| 3,944,876 | 3/1976 | Helmuth | 315/205 |
| 3,969,652 | 7/1976 | Herzog | 315/224 |
| 3,997,814 | 12/1976 | Toho | 315/200 |
| 4,004,188 | 1/1977 | Cooper | 315/261 |
| 4,015,167 | 3/1977 | Samuels | 315/99 |
| 4,023,067 | 5/1977 | Zelina et al. | 315/209 |
| 4,037,148 | 7/1977 | Owens et al. | 323/17 |
| 4,039,897 | 8/1977 | Dragoset | 315/205 |
| 4,051,410 | 9/1977 | Knoble | 315/205 |
| 4,051,411 | 9/1977 | Knoble et al. | 315/205 |
| 4,060,751 | 11/1977 | Anderson | 315/209 |
| 4,060,752 | 11/1977 | Walker | 315/244 |
| 4,069,442 | 1/1978 | Soileau | 315/208 |
| 4,072,878 | 2/1978 | Engel et al. | 315/205 |
| 4,079,292 | 3/1978 | Kaneda | 315/289 |
| 4,087,702 | 5/1978 | Kirby et al. | 307/252 |
| 4,119,887 | 10/1978 | Iyama et al. | 315/101 |
| 4,119,888 | 10/1978 | Newell et al. | 315/207 |
| 4,163,923 | 8/1979 | Herbers et al. | 315/205 |
| 4,165,475 | 8/1979 | Pegg et al. | 315/99 |
| 4,177,403 | 12/1979 | Remery | 315/101 |
| 4,236,100 | 11/1980 | Nuver | 315/92 |
| 4,258,295 | 3/1981 | Siglock | 315/189 |
| 4,277,118 | 10/1980 | Britton | 315/240 |
| 4,339,695 | 7/1982 | Siglock | 315/276 |
| 4,347,462 | 8/1982 | Adachi | 315/290 |
| 4,370,600 | 1/1983 | Zansky | 315/244 |
| 4,380,719 | 4/1983 | De Bijl et al. | 315/101 |
| 4,392,087 | 7/1983 | Zansky | 315/219 |
| 4,437,043 | 3/1984 | Pitel | 315/308 |
| 4,441,056 | 4/1984 | Siglock | 315/290 |
| 4,442,380 | 4/1984 | Adachi | 315/101 |
| 4,445,074 | 4/1984 | Watanabe | 315/205 |
| 4,460,848 | 7/1984 | Fahnrich | 315/101 |
| 4,476,414 | 10/1984 | Jimerson | 315/240 |
| 4,488,087 | 12/1984 | Adachi et al. | 315/101 |
| 4,503,359 | 5/1985 | Watanabe et al. | 315/105 |
| 4,503,363 | 5/1985 | Nilssen | 315/225 |
| 4,513,227 | 4/1985 | Labadini et al. | 315/290 |
| 4,525,648 | 6/1985 | De Bijl et al. | 315/224 |
| 4,629,944 | 12/1986 | Maytum et al. | 315/207 |
| 4,631,450 | 12/1986 | Lagree et al. | 315/244 |
| 4,975,476 | 2/1978 | Pitel | 315/209 |

*Primary Examiner*—David K. Moore

*Attorney, Agent, or Firm*—Vaden, Eickenroht, Thompson & Boulware

[57] ABSTRACT

A striker circuit is provided for high intensity discharge lamps that uses a clamping circuit applied to the AC line current to generate a clamped voltage differential for striking the lamp. A clamped voltage differential is generated at fixed intervals until the lamp is struck. The emission of the clamped voltage differentials is stopped when the current flowing through the lamp is above a fixed value. The clamped voltage differential is re-clamped if it drifts from its desired, clamped waveform.

3 Claims, 3 Drawing Sheets

BALLAST STRIKER CIRCUIT

FIELD OF THE INVENTION

This invention relates to ballasts used for high intensity discharge (HID) lamps, including mercury vapor and fluorescent lamps. More particularly, this invention relates to circuits for striking or starting HID lamps.

BACKGROUND OF THE INVENTION

High intensity discharge (HID) lamps are increasingly being used in a wide variety of applications due to their greater efficiency, lower power requirements, and higher light outputs as compared to incandescent lights.

However, the starting and operation of HID lamps require substantially more control over the power to the lamp than is required by incandescent lamps. More particularly, HID lamps typically require a voltage pulse to start or strike the lamp that is significantly higher than the operating voltage across the lamp and the input line voltage. A ballast having a triggering mechanism is typically used to provide such a strike pulse.

There are many known ballasts using a variety of triggering mechanisms. These prior art triggering mechanisms are often ineffective, unreliable, or unduly complicated. Since HID lamps are often used in applications that require a high degree of confidence that the lamp will be reliably struck, such as for security and street lights, it is highly desirable to provide a HID light that will be turned on in a consistent, predictable fashion.

Also, HID lamps are often used in relatively inaccessible locations, such as on tall light poles or attached to the sides or ceilings of large buildings. It is desirable to provide a HID lamp that will start and operate reliably in such applications due to the difficulty of repairing a light fixture in such locations.

SUMMARY OF THE INVENTION

A striker circuit is provided for high intensity discharge lamps that uses a clamping circuit applied to the AC line current to generate a clamped voltage differential for striking the lamp. In a preferred embodiment, the clamping circuit clamps the 120 volts, 60 cycle AC input line current to create a sinusoidal waveform across the lamp that is substantially of a single polarity. Other waveforms may be used and are within the scope of this invention. The peak amplitude of the clamped voltage differential is less than a reference value. In a preferred embodiment, the reference value is +20 volts, so that the clamped voltage differential varies from about positive 20 volts to about negative 300 volts.

A clamped voltage differential is generated on the negative half cycle of the AC line voltage, when the clamped voltage across the lamp reaches a negative 300 volts. If the lamp does not immediately strike, a clamped voltage differential may continue to be generated on each negative half cycle of the AC line current, or at other fixed intervals. The emission of the clamped voltage differential is stopped when the current flowing through the lamp is above a fixed value.

The clamped waveform has a tendency to increase or drift over time. In a preferred embodiment, the +20, −300 volt sinusoidal waveform is allowed to increase to a +32, −288 volt sinusoidal waveform whereupon the triac refires and reclamps the waveform to the +20, −300 volt waveform. Of course, other reclamping means would be obvious to those skilled in the art and are also within the scope of this invention.

It is a feature of the present invention to use a clamping circuit to generate a clamped voltage differential for striking a high intensity discharge lamp.

It is another feature of the present invention to reclamp the clamped waveform if it increases by a predetermined value.

It is yet another feature of the present invention to sense the amount of current flowing through the lamp to determine whether to stop the emission of additional clamped voltage differentials.

These and other features of the present invention will be apparent to those skilled in the art from the following detailed description.

IN THE DRAWINGS

DETAILED DESCRIPTION

Figure 1:
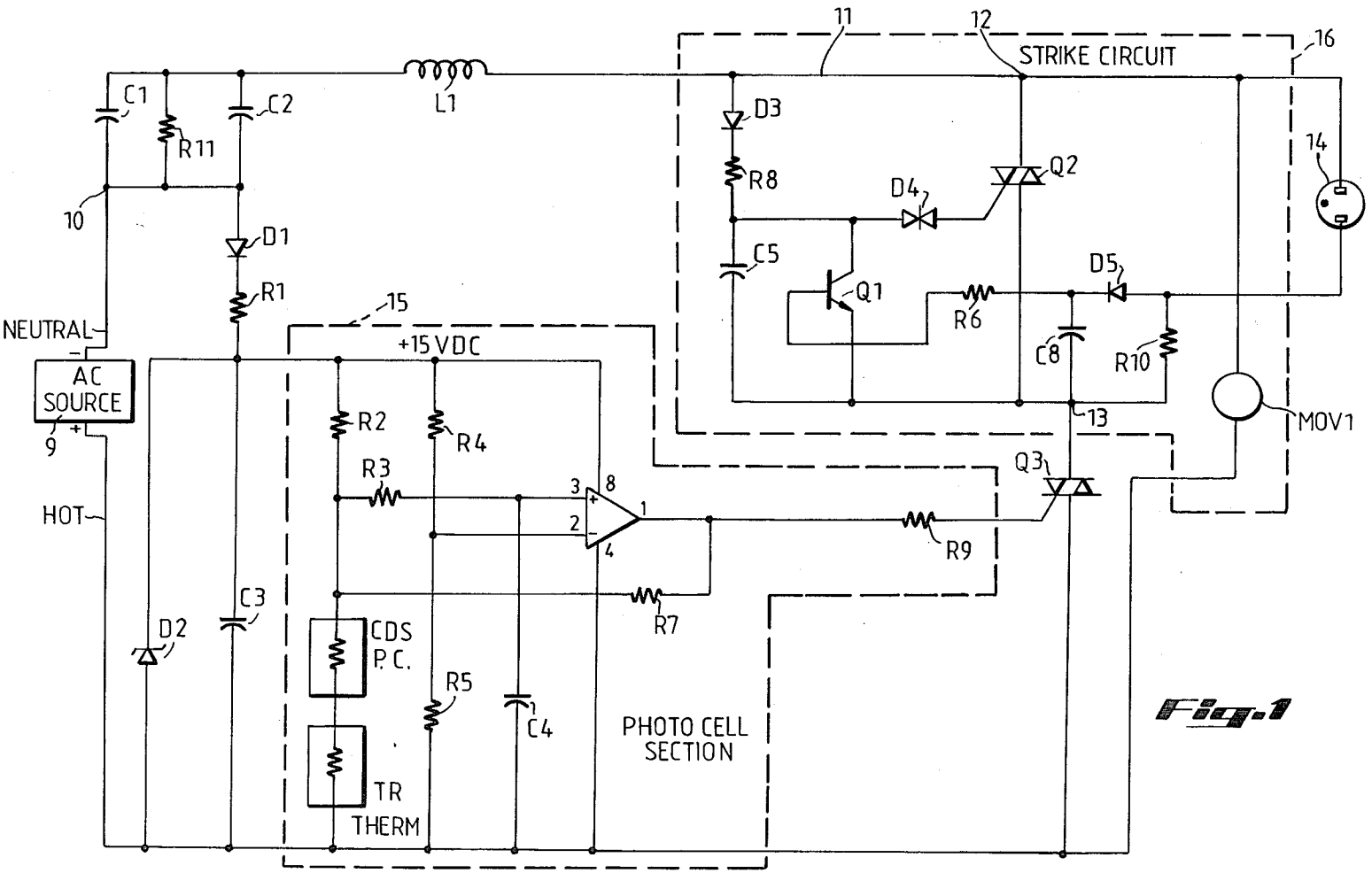
FIG. 1 is a schematic circuit drawing depicting the invention used in connection with a mercury vapor lamp.

Referring to FIG. 1, the ballast circuit includes a 120 volt, 60 Hertz AC source 9 for providing power to high intensity discharge lamp 14. Other suitable power supplies may be used.

The ballast circuit also includes a half wave low voltage power supply that provides, in a preferred embodiment, +15 volts of direct current to photocell 15 for powering the photocell. The half wave low voltage power supply is comprised of diode D1, resistor R1, zener diode D2 and capacitor C3.

When photocell 15 determines that lamp 14 should be turned on, it sends a sufficient amount of current through resistor R9 to turn on triac Q3. The turning on of triac Q3 allows current from AC source 9 to pass through triac Q3 to striker circuit 16.

Referring again to FIG. 1, current flow through lamp 14 is controlled by capacitors C1 and C2, and inductor L1. Resistor R11 discharges capacitors C1 and C2 over a long period of time as a safety feature. Diode D3 ensures that a clamped voltage differential to lamp 14 only occurs on negative half cycles of the AC line current.

On positive half cycles of the AC line current, capacitor C5 will charge through resistor R8 and diode D3 until it reaches the striking voltage of diac D4. When diac D4 conducts, capacitor C5 discharges through diac D4 into the gate of triac Q2. Triac Q2 charges capacitors C1 and C2 to the full positive amplitude of the line voltage, which places a positive 160 volts at point 10.

The opposite side of capacitor C1 is clamped to about positive 20 volts on the positive half cycle of the AC line current.

Figure 4:
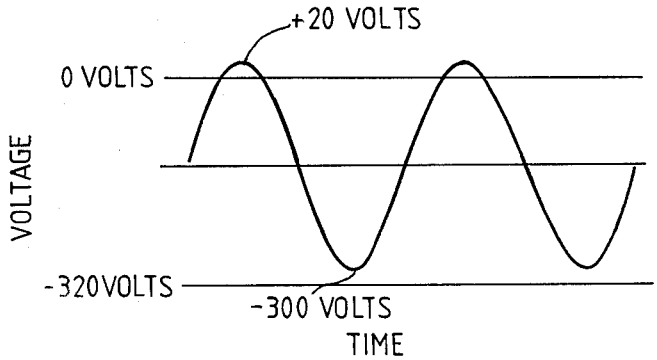
FIG. 4 depicts a clamped sine waveform that appears across the high intensity discharge lamp.

Capacitors C1 and C2 charges to positive 160 volts. When the AC line voltage reverses and begins to go negative, triac Q2 stops conducting. This results in a negative voltage waveform being formed on line 11 at point 12 with respect to point 13. This negative waveform is depicted in FIG. 4. As shown in FIG. 1, point 13 is connected to one side of AC source 9. The voltage at point 12 is approximately a negative 320 volts with respect to the voltage at point 13. This voltage differential impresses a 320 volt, clamped voltage signal across lamp 14, which should be sufficient to strike the lamp.

If lamp 14 does not strike or merely flickers, or if it extinguishes for any reason, the above-described striking circuit will emit clamped voltage differentials on every negative half cycle of the AC line current until the lamp has cooled down sufficiently so that its firing voltage is at or below 320 volts, at which point it will strike.

Once the lamp is struck, it operates on the line current from AC source 9, unless switched off by the action of photocell 15.

Resistor R10 senses whether current has been reliably established through the lamp. When current through the lamp has been reliably established, the positive portions of the line current waveform are coupled through diode D5 into filter capacitor C8, which turns on transistor Q1. The turning on of transistor Q1 stops the generation of clamped voltage differentials by the striker circuit.

Transient, high voltage spikes sometimes appear on the AC line, or are generated when the lamp flickers or is extinguished. These voltage spikes may be sufficiently high to destroy triac Q2 or Q3.

In order to protect triacs Q2 and Q3 from such high voltage spikes, a spike protector MOV1 is provided as shown in FIG. 1. In a preferred embodiment, spike protector MOV1 may be a 240 volt, AC metal oxide varistor that clips the voltage spikes to a level of 340 volts or less.

Figure 5:
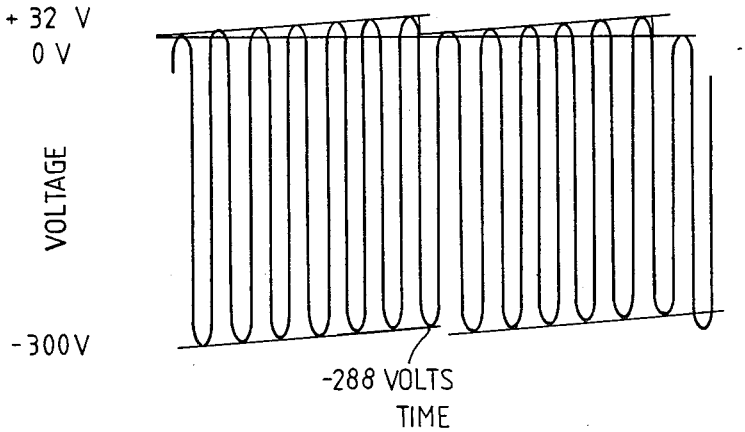
FIG. 5 depicts the drifting and reclamping of the waveform appearing across the lamp.

The +20, −300 volt clamped waveform upsets the timing of the striking circuit since only +20 volts is applied to the striking circuit. This causes the +20, −300 volt waveform to drift slowly upward. When the waveform has drifted to the point that it has increased to a +32, −288 volt waveform, triac Q2 fires to reclamp the waveform to the +20, −300 volt waveform. FIG. 5 depicts the drifting clamped waveform and the effect of reclamping it by firing triac Q2.

Figure 2:
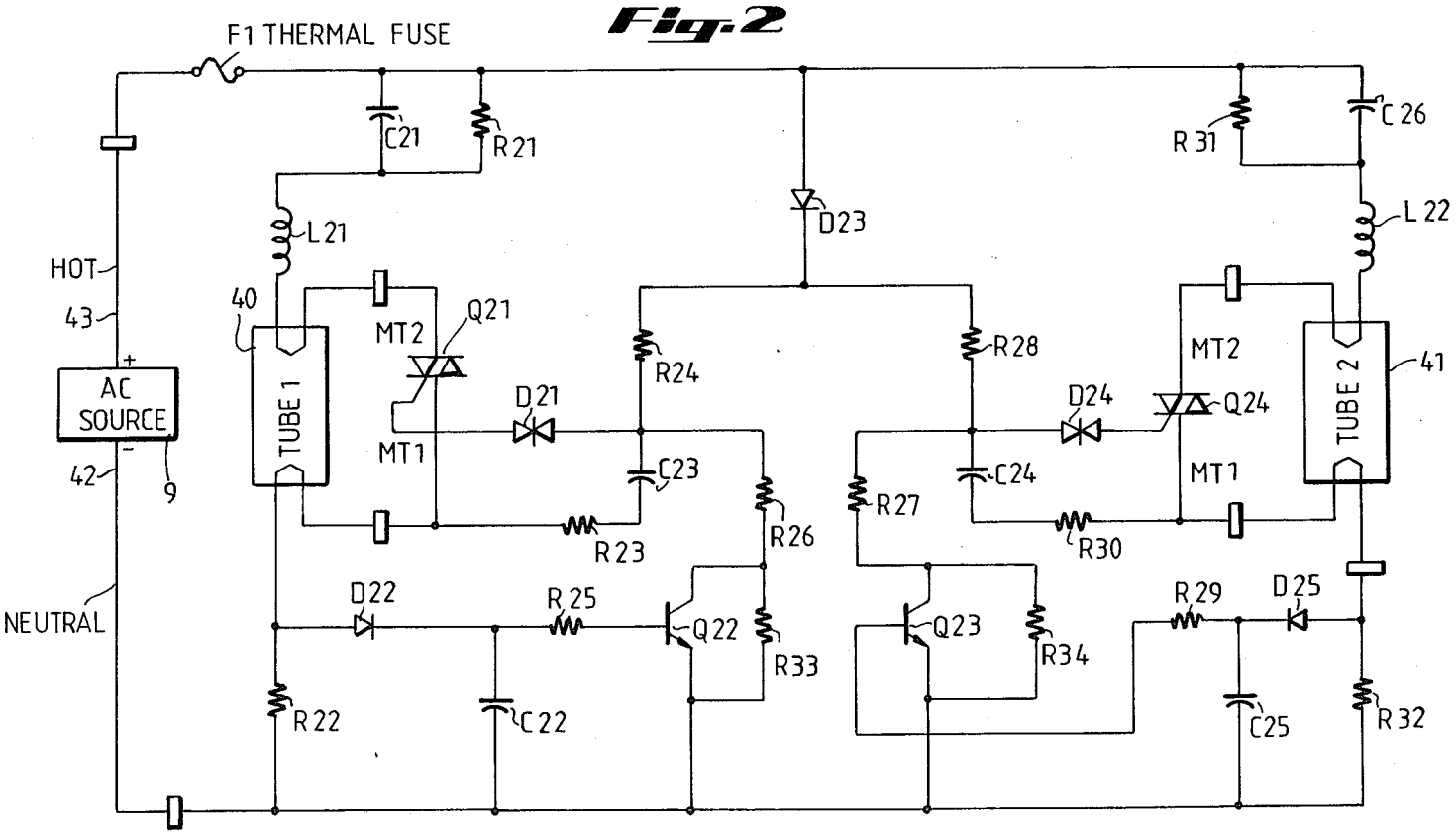
FIG. 2 is a schematic circuit drawing depicting the invention used in connection with two fluorescent lamps.
Figure 3:
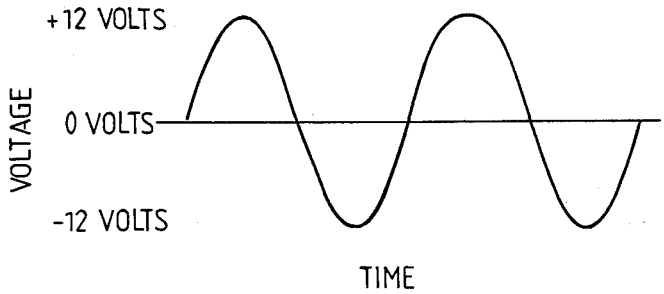
FIG. 3 depicts the sine waveform of the input AC line current.

FIG. 2 depicts another preferred embodiment of the present invention. The ballast circuits shown in FIG. 2 are used to power two fluorescent tubes 40 and 41. Since each tube is powered by an identical ballast circuit, only the ballast circuit that powers tube 40 on the left-hand side of FIG. 2 will be discussed.

The circuit depicted in FIG. 2 works as follows. Current from a 118 volt AC, 60 Hz current source 42 travels through line 43 across the fuse F1. Fuse F1 is a microtemp thermal fuse that blows whenever the temperature in the ballast reaches a predetermined value.

The current then travels through capacitor C21 and a capacitor discharge resistor R21. Current flow through fluorescent tube 40 is limited by capacitor C21, inductor L21, resistor R22 as well as by the inherent impedance of tube 40.

Triac Q21 is connected across tube 40, and is used to strike the tube. The firing of triac Q21 is controlled by diode D23 so that triac Q21 may only fire on the positive half cycles of the line current.

Resistor R24 and capacitor C23 comprise a timing circuit. This timing circuit causes the voltage across tube 40 to nearly reach a peak voltage, on the order of 135 volts. When the voltage across capacitor C23 reaches a predetermined value, diac D21 fires, which in turn causes triac Q21 to fire.

The firing of triac Q21 charges capacitor C21 to a positive 160 volts on one side of capacitor C21. The firing of triac Q21 also preheats the filaments of tube 40. Such preheating is desirable to lower the striking voltage of the tube.

The charging of one side of capacitor C21 to +160 volts impresses a negative 320 volts across tube 40 when the AC line current waveform goes negative. This voltage results in a 320 volt clamped voltage differential that is sufficient to strike the tube. The waveform that is developed across tube 40 is an AC clamped waveform.

Although the waveforms developed across the lights in FIG. 1 and FIG. 2 are depicted and described as negative ones, it is obvious that a positive, clamped waveform could easily be developed instead. The use of either a positive or a negative waveform is within the scope of this invention.

Triac Q21 will continue to fire on each positive half cycle until a reliable current flow is established through tube 40. The current flow through tube 40 is sensed by a current sensing resistor R22, and is rectified by diode D22 and capacitor C22. Resistor R25 limits the current developed across capacitor C22 that travels to the base of transistor Q22, causing it to conduct. The conduction of transistor Q22 indicates that a reliable current has been established through tube 40. The conduction of transistor Q22 effectively places a short circuit across capacitor C23, thereby stopping the firing of triac Q1. This stops the emission of clamped voltage differentials to tube 40.

After tube 40 has been struck, current flows through the center of the tube. Current to the tube is then limited by capacitor C21, inductor L21, the inherent impedance of tube 40 itself, and to a lesser degree, by resistor R22.

What is claimed is:

1. A circuit for striking a high intensity discharge lamp, comprising:
   - generating means for generating an alternating current signal;
   - a high intensity discharge lamp;
   - clamping means for clamping said alternating current signal to a reference value and for outputting a clamped voltage differential corresponding to the clamped alternating current signal;
   - circuit means for applying said clamped voltage differential to said lamp to strike said lamp;
   - means for sensing the amount of current flowing through said lamp; and
   - means for disabling said clamping means when the sensed current flowing through said lamp is greater than a predetermined value.

2. A circuit for striking a high intensity discharge lamp, comprising:
   - generating means for generating an alternating current signal;
   - clamping means for clamping said alternating current signal to a reference value and for outputting a clamped voltage differential, that is substantially of a single polarity, corresponding to the clamped alternating current signal;
   - a high intensity discharge lamp;
   - circuit means for applying said clamped voltage differential to said lamp to strike said lamp;
   - means for sensing the amount of current flowing through said lamp; and means for disabling said clamping means when the sensed current flowing through said lamp is greater than a predetermined value.

3. A circuit for striking a high intensity discharge lamp, comprising:

generating means for generating an alternating current signal;

a high intensity discharge lamp;

clamping means for clamping said alternating current signal to a reference value and for outputting a clamped voltage differential corresponding to the clamped alternating current signal during every other half cycle of said alternating current signal until said lamp is struck;

means for sensing the amount of current flowing through said lamp; and means for disabling said clamping means when the sensed current flowing through said lamp is greater than a predetermined value.

* * * * *